US009643806B2

(12) United States Patent
Shinohara

(10) Patent No.: US 9,643,806 B2
(45) Date of Patent: May 9, 2017

(54) PAPER TRANSFER DEVICE

(71) Applicant: RISO KAGAKU CORPORATION, Tokyo (JP)

(72) Inventor: Masaaki Shinohara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/012,004

(22) Filed: Feb. 1, 2016

(65) Prior Publication Data

US 2016/0251180 A1 Sep. 1, 2016

(30) Foreign Application Priority Data

Feb. 27, 2015 (JP) ..... 2015-038102

(51) Int. Cl.

| | |
|---|---|
| ***B65H 5/36*** | (2006.01) |
| ***B65H 5/02*** | (2006.01) |
| ***B41J 11/00*** | (2006.01) |
| ***B65H 5/22*** | (2006.01) |
| ***B41J 2/01*** | (2006.01) |

(52) U.S. Cl.

CPC ..... *B65H 5/36* (2013.01); *B41J 2/01* (2013.01); *B41J 11/005* (2013.01); *B41J 11/0085* (2013.01); *B65H 5/021* (2013.01); *B65H 5/026* (2013.01); *B65H 5/224* (2013.01)

(58) Field of Classification Search

CPC . B65H 5/026; B65H 5/36; B65H 5/021; B41J 11/0085; B41J 11/005

See application file for complete search history.

(56) References Cited

U.S. PATENT DOCUMENTS

| | | | | |
|---|---|---|---|---|
| 6,764,236 | B2 * | 7/2004 | Suzuki | G03G 15/231 101/230 |
| 8,308,156 | B2 | 11/2012 | Shinohara | |
| 8,528,898 | B2 * | 9/2013 | Kushida | B65H 29/125 271/225 |
| 8,579,287 | B1 * | 11/2013 | Herrmann | B65H 29/125 271/301 |
| 2007/0205552 | A1 * | 9/2007 | Taniguchi | B65H 29/58 271/303 |
| 2008/0042344 | A1 * | 2/2008 | Song | H04N 1/00572 271/303 |
| 2010/0327510 | A1 * | 12/2010 | Matsuno | B41J 11/006 271/3.14 |

(Continued)

FOREIGN PATENT DOCUMENTS

| | | |
|---|---|---|
| JP | 2010-111507 | 5/2010 |

*Primary Examiner* — Patrick Cicchino

(74) *Attorney, Agent, or Firm* — Hamre, Schumann, Mueller & Larson, P.C.

(57) ABSTRACT

A paper transfer device includes a paper transfer unit that transfers a paper laid on a transfer surface beneath an inkjet head, a downstream-side transfer portion that is disposed on a downstream side of the transfer unit along a transfer direction of the paper and transfers the paper along a downstream-side transfer path extending downward from the transfer surface, a paper leading portion that leads the paper from the transfer unit to the downstream-side transfer portion, and a controller that controls the paper leading portion to press the paper after a leading end of the paper is led to the downstream-side transfer portion by the paper leading portion.

2 Claims, 7 Drawing Sheets

(56) References Cited

U.S. PATENT DOCUMENTS

| | | | | |
|---|---|---|---|---|
| 2013/0106051 | A1* | 5/2013 | Deguchi | G03G 15/1665 271/226 |
| 2014/0353908 | A1* | 12/2014 | Kobayashi | B65H 9/00 271/226 |
| 2015/0108715 | A1* | 4/2015 | Yamada | B65H 85/00 271/272 |
| 2016/0090254 | A1* | 3/2016 | Iijima | B65H 85/00 271/225 |

* cited by examiner

PAPER TRANSFER DEVICE

BACKGROUND OF THE INVENTION

Technical Field

The present invention relates to a paper transfer device.

Background Arts

A line-type inkjet printer in which printing is done by ejecting inks from fixed inkjet heads onto a paper while transferring the paper is generally known.

Such a line-type inkjet printer is provided with an under-head transfer unit that transfers a paper just under inkjet heads while suctioning the paper onto its transfer surface. With respect to such an under-head transfer unit, a so-called air-suction type is widely known (e.g. see a Patent Document 1: Japanese patent application publication No. 2010-111507).

An air-suction type under-head transfer unit includes a transfer belt on which a lot of through holes are formed, a chamber that forms a negative pressure chamber for generating suction forces through the through holes of the transfer belt, and a fan that exhausts air from the chamber. Negative pressure is generated in the chamber by driving the fan, and thereby air is suctioned through the through holes to generate suction forces at the through holes of the transfer belt. The transfer belt is moved while holding a paper thereon by the suction forces, so that the paper is transferred.

In such an air-suction type under-head transfer unit, a transfer belt is looped over rollers distanced from each other along a transfer direction, and a chamber is disposed beneath the transfer belt and between the rollers. Due to the configuration explained above, there are areas that cannot be covered by suctioning of the chamber at an upstream-side end and a downstream-side end on the transfer belt. Within the areas, air is not suctioned (sufficiently) through the through holes of the transfer belt. Therefore, suction forces become weakened on upstream and downstream sides of the air-suction type under-head transfer unit.

There exists a line-type inkjet printer in which a paper is transferred along a transfer path extending downward from its air-suction type under-head transfer unit. When a leading end of a paper is led to the transfer path extending downward from the under-head transfer unit in such an inkjet printer, an upward force occurs at a trailing end of the paper due to stiffness of the paper. In addition, as explained above, suction forces is weakened on a downstream side of the under-head transfer unit. Therefore, the trailing end of the paper whose leading end is being led to the transfer path extending downward becomes easily uplifted from a transfer surface of the transfer belt.

When the paper is uplifted from the transfer surface, it is concerned that the paper may contact with inkjet heads. If the paper contacts with the inkjet heads, the inkjet heads may be damaged. If a mechanism for pressing the paper such as a roller is provided on the downstream side of the under-head transfer unit in consideration of these concerns, the paper can be prevented from being uplifted.

SUMMARY OF THE INVENTION

However, such a mechanism for pressing a paper provided on the downstream side of the under-head transfer unit makes configurations of the device complicated.

An object of the present invention is to provide a paper transfer device that can prevent the device from being complicated, and suppress an uplift of a paper from a transfer surface.

An aspect of the present invention provides a paper transfer device comprising: a paper transfer unit that transfers a paper laid on a transfer surface beneath an inkjet head; a downstream-side transfer portion that is disposed on a downstream side of the transfer unit along a transfer direction of the paper, and transfers the paper along a downstream-side transfer path extending downward from the transfer surface; a paper leading portion that leads the paper from the transfer unit to the downstream-side transfer portion; and a controller that controls the paper leading portion to press the paper after a leading end of the paper is led to the downstream-side transfer portion by the paper leading portion.

According to the aspect, since the paper is pressed by the paper leading portion, it is needed to provide a special mechanism only for pressing the paper. Therefore, the paper transfer device can be prevented from being complicated, and can suppress an uplift of the paper from the transfer surface.

It is preferable that the controller controls press-start timing for the paper by the paper leading portion according to at least one of a paper type and a paper size of the paper.

According to this configuration, the paper can be restricted from being uplifted from the transfer surface while a printed media can be restricted from being smudged.

It is preferable that the paper leading portion includes a rotational member that presses the paper while the rotational member rotates.

According to this configuration, smudges of a printed media caused by being pressed can be restricted.

DESCRIPTION OF THE EMBODIMENTS

Figure 1:
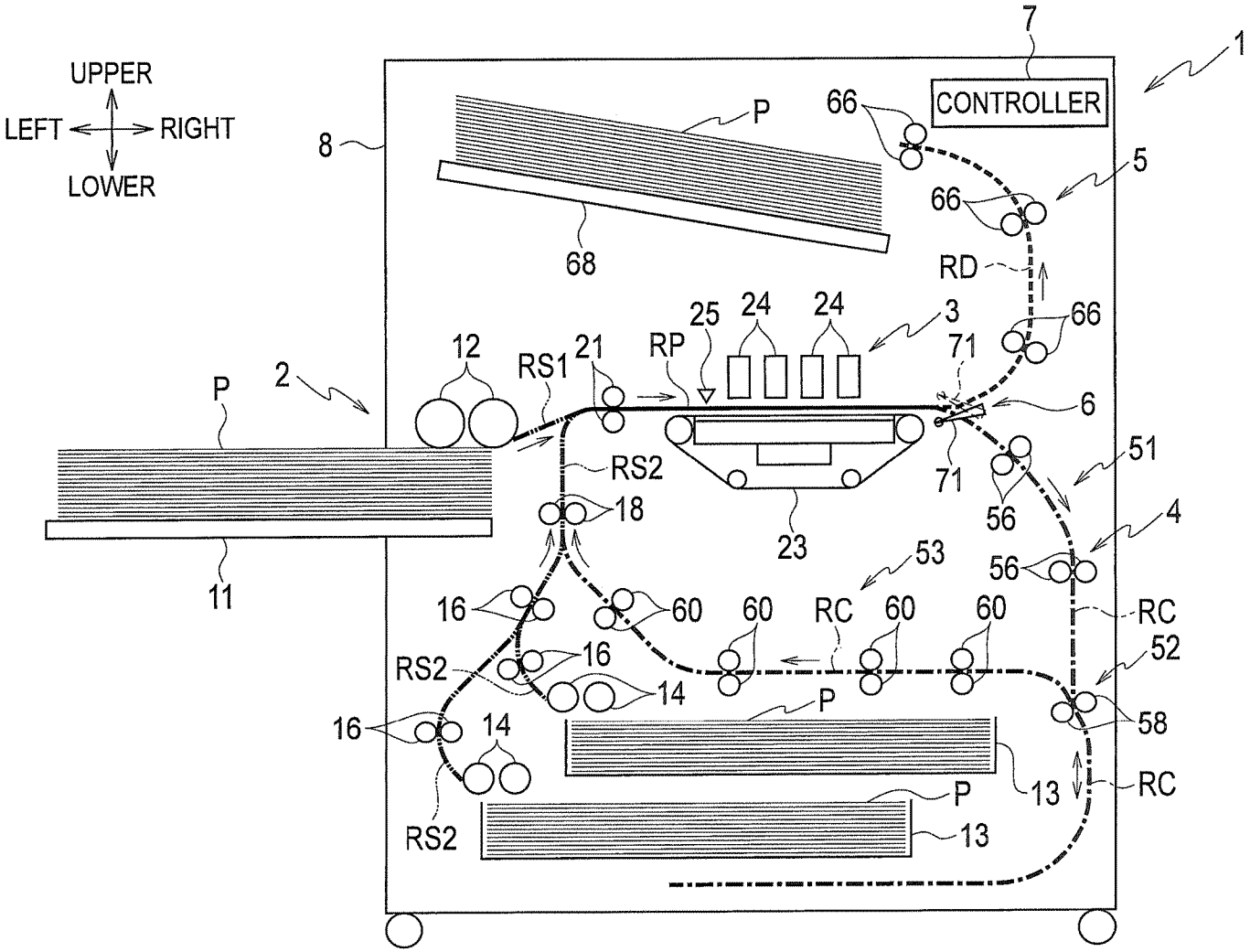
FIG. 1 is a configurational diagram of a printer provided with a paper transfer device according to an embodiment.

Hereinafter, an embodiment will be described with reference to the drawings. In the drawings, identical or equivalent portions or components to each other are labeled with identical reference numbers.

The embodiment described below is shown as an example that specifically achieves the subject matter of the present invention. In addition, materials, shapes, dimensions, structures, arrangements of components in the embodiment are not limited to those in the embodiment. The embodiment may be modified within the scope of the claims.

In descriptions made below, "upper", "lower", "left", and "right" are denoted as shown in FIG. 1 for convenience of explanations. Similarly, "front" is denoted as your side when viewing FIG. 1, and "rear" is denoted as an opposite side to the "front" when viewing FIG. 1.

As shown in FIG. 1, bold lines (solid, dotted and so on) indicate transfer paths along which a paper as a print media is transferred. A print path RP is indicated by a solid line. A circular path RC is indicated by dashed one-dotted lines. A paper ejection path RD is indicated by a dotted line. An external paper feed path RS1 and internal paper feed paths RS2 are indicated by dashed two-dotted lines. In following descriptions, terms "upstream" and "downstream" mean upstream and downstream along the transfer paths, respectively.

Figure 2:
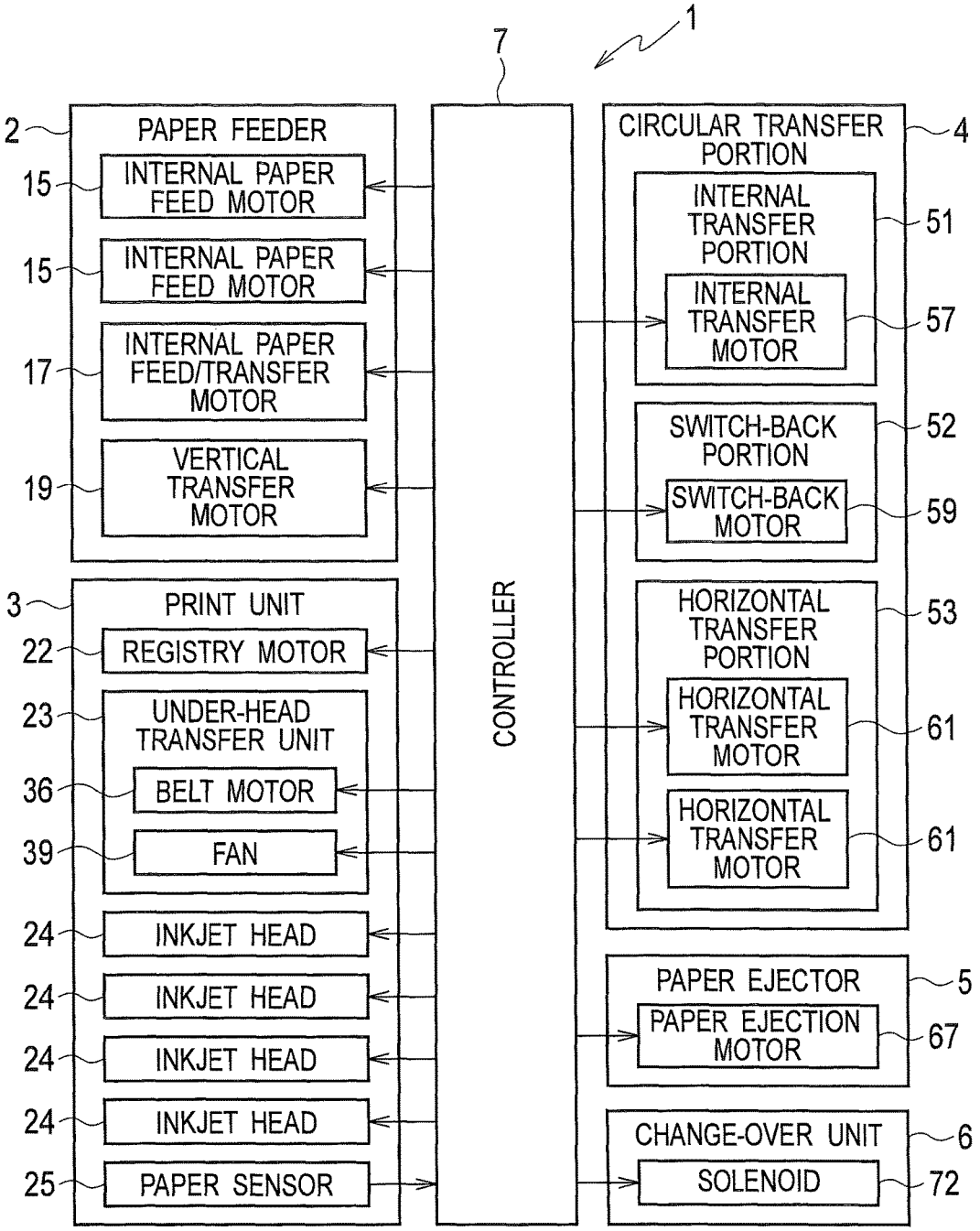
FIG. 2 is a block diagram of the printer.

As shown in FIG. 1 and FIG. 2, a printer 1 in the present embodiment includes a paper feeder 2, a print unit 3, a circular transfer portion 4, a paper ejector 5, a change-over unit 6, a controller 7, and a housing 8 that houses or supports the above components. A paper transfer device defined in Claims includes an under-head transfer unit 23 (that corresponds to a transfer unit in Claims) that will be described later, an intermediate transfer portion 51 (that corresponds to a downstream-side transfer portion in Claims), a flipper 71 (that corresponds to a paper leading portion in Claims), and the controller 7.

The paper feeder 2 feeds a paper(s) to the print unit 3. In addition, the paper feeder 2 refeeds a paper P whose one side has been printed during duplex printing. The paper feeder 2 is disposed at a most-upstream position of the transfer paths. The paper feeder 2 includes an external paper feed tray 11, a pair of external paper feed rollers 12, two internal paper feed trays 13, two pairs of internal paper feed rollers 14, two internal paper feed motors 15, three pairs of internal paper feed/transfer rollers 16, an internal paper feed/transfer motor 17, a pair of vertical transfer rollers 18, and a vertical transfer motor 19.

On the external paper feed tray 11, papers P on which images are to be printed are stacked. The external paper feed tray 11 is provided in a state where it is partially protruded out from the housing 8.

The pair of external paper feed rollers 12 picks up papers P stacked on the external paper feed tray 11 sheet by sheet, and then feeds them sequentially to a pair of registry rollers 21 that will be described later.

Also on the internal paper feed trays 13, papers P on which images are to be printed are stacked. The internal paper feed trays 13 are disposed within the housing 8.

Each pair of the internal paper feed rollers 14 picks up papers P stacked on the correspondent internal paper feed tray 13 sheet by sheet, and then feeds them sequentially to the correspondent pair of internal paper feed/transfer rollers 16.

Each of the two internal paper feed motors 15 drives the correspondent pair of internal paper feed rollers 14 to rotate them.

The pairs of internal paper feed/transfer rollers 16 transfer the papers P that are fed out from the internal paper feed trays 13 by the pairs of internal paper feed rollers 14 to the pair of vertical transfer rollers 18. The pairs of internal paper feed/transfer rollers 16 are disposed on the internal paper feed paths RS2.

The internal paper feed/transfer motor 17 drives the pairs of internal paper feed/transfer rollers 16 to rotate them.

The pair of vertical transfer rollers 18 transfers the papers P that are fed along the internal paper feed paths RS2 by the pairs of internal paper feed/transfer rollers 16 to the registry rollers 21. In addition, the pair of vertical transfer rollers 18 transfers the paper P whose one side has been printed during duplex printing and that is transferred along the circular path RC to the pair of registry rollers 21. The pair of vertical transfer rollers 18 is disposed on the internal paper feed path RS2 on a downstream side from a confluent point of the circular path RC with the internal paper feed path RS2.

The vertical transfer motor 19 drives the pair of vertical transfer rollers 18 to rotate them. In addition, the vertical transfer motor 19 also drives the pair of external paper feed rollers 12 to rotate them. The vertical transfer motor 19 is connected with the pair of vertical transfer rollers 18 via a one-way clutch (not shown in the drawings), and is also connected with the pair of external paper feed rollers 12 via another one-way clutch (not shown in the drawings). Therefore, the pair of vertical transfer rollers 18 is driven by rotations of the vertical transfer motor 19 to one rotational direction, and the pair of external paper feed rollers 12 is driven by rotations of the vertical transfer motor 19 to another rotational direction opposite to the one direction.

The print unit 3 prints images on a paper P while transferring the paper P. The print unit 3 is disposed on a downstream side of the paper feeder 2. The print unit 3 includes the pair of registry rollers 21, a registry motor 22, the under-head transfer unit 23, four inkjet heads 24, and a paper sensor 25.

The pair of registry rollers 21 temporarily stops a paper P transferred by the pair of external paper feed rollers 12 or the pair of vertical transfer rollers 18 to correct oblique transfer of the paper P, and then transfers the paper P to the under-head transfer unit 23. The pair of registry rollers 21 is disposed on the print path RP at an upstream section of the print unit 3.

The registry motor 22 drives the pair of registry rollers 21 to rotate them.

Figure 3:
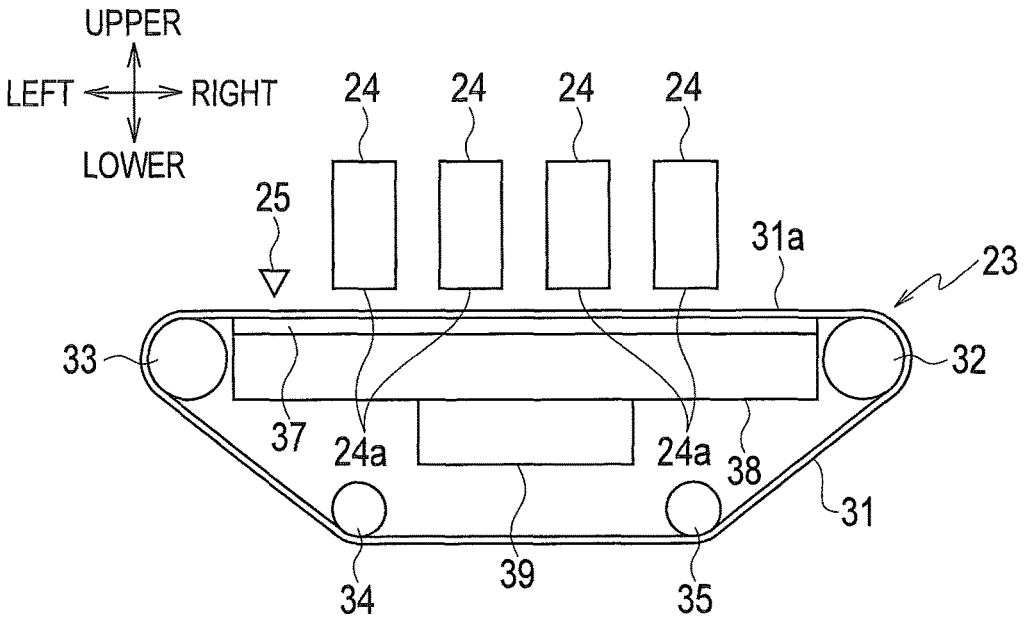
FIG. 3 is an enlarged front view of a print unit of the printer.

The under-head transfer unit 23 transfers a paper P transferred by the pair of registry rollers 21 while holding the paper P by air-suctioning. The under-head transfer unit 23 is disposed on a downstream side of the pair of registry rollers 21. As shown in FIG. 3, the under-head transfer unit 23 includes a transfer belt 31, a drive roller 32, driven rollers 33 to 35, a belt motor 36, a platen plate 37, a chamber 38, and a fan 39.

The transfer belt 31 transfers a paper P while suctioning the paper P to hold the paper P. The transfer belt 31 is an endless belt looped over the drive roller 32 and the driven rollers 33 to 35. A lot of belt holes (not shown in the drawings) are formed on the transfer belt 31. The transfer belt 31 holds a paper P on its transfer surface 31*a* by suction forces generated at the belt holes by driving the fan 39. The transfer surface 31*a* is an upper surface of the transfer belt 31 beneath the inkjet heads 24. The transfer surface 31*a* configures part of the print path RP. During printing, the transfer belt 31 transfers a paper P laid on the transfer surface 31*a* rightward in FIG. 3 by being fed circularly in a clockwise direction in FIG. 3.

The drive roller 32 feeds the transfer belt 31 circularly.

The driven rollers 33 to 35 support the transfer belt 31 together with the drive roller 32. The driven rollers 33 to 35 are driven by the drive roller 32 via the transfer belt 31. The driven roller 33 is disposed on a left side of the drive roller 32 at an identical height level to a height level of the drive roller 32. The driven rollers 34 and 35 are disposed beneath the drive roller 32 and the driven roller 33 at an identical height level to each other so as to be distanced from each other in a left-right direction.

The belt motor 36 drives the drive roller 32 to rotate it.

The platen plate 37 is disposed under the transfer belt 31 between the drive roller 32 and the driven roller 33, and supports a lower surface of the transfer belt 31 slidably. The platen plate 37 is provided with a lot of suction holes (not shown in the drawings) at positions over which the belt holes of the transfer belt 31 pass.

The chamber 38 forms a negative pressure chamber for generating the suction forces at the belt holes of the transfer belt 31 via the suction holes of the platen plate 37. The chamber 38 is disposed on a lower-surface side of the platen plate 37 between the drive roller 32 and the driven roller 33.

The fan 39 exhausts air from the chamber 38. Therefore, the fan 39 generates negative pressure in the chamber 38, and suctions air through the suction holes of the platen plate 37 and the belt holes of the transfer belt 31. As the result, the fan 39 generates negative pressure at the belt holes, and a paper P is suctioned onto the transfer surface 31*a* of the transfer belt 31.

The inkjet heads 24 eject inks onto a paper P transferred by the under-head transfer unit 23. The four inkjet heads 24 are aligned in a transfer (left-right) direction of the paper P above the under-head transfer unit 23. Each of the inkjet heads 24 has an ink ejection surface 24*a*. The ink ejection surface 24*a* is a bottom surface of the inkjet head 24 that faces to the transfer surface 31*a* of the transfer belt 31. On the ink ejection surface 24*a*, plural nozzles (not shown in the drawings) are opened so as to be aligned in a front-rear (primary sweep) direction. The inkjet heads 24 eject inks from the nozzles.

The paper sensor 25 detects a paper P transferred by the under-head transfer unit 23. The paper sensor 25 is disposed on an upstream side of the most-upstream inkjet head 24.

Figure 5:
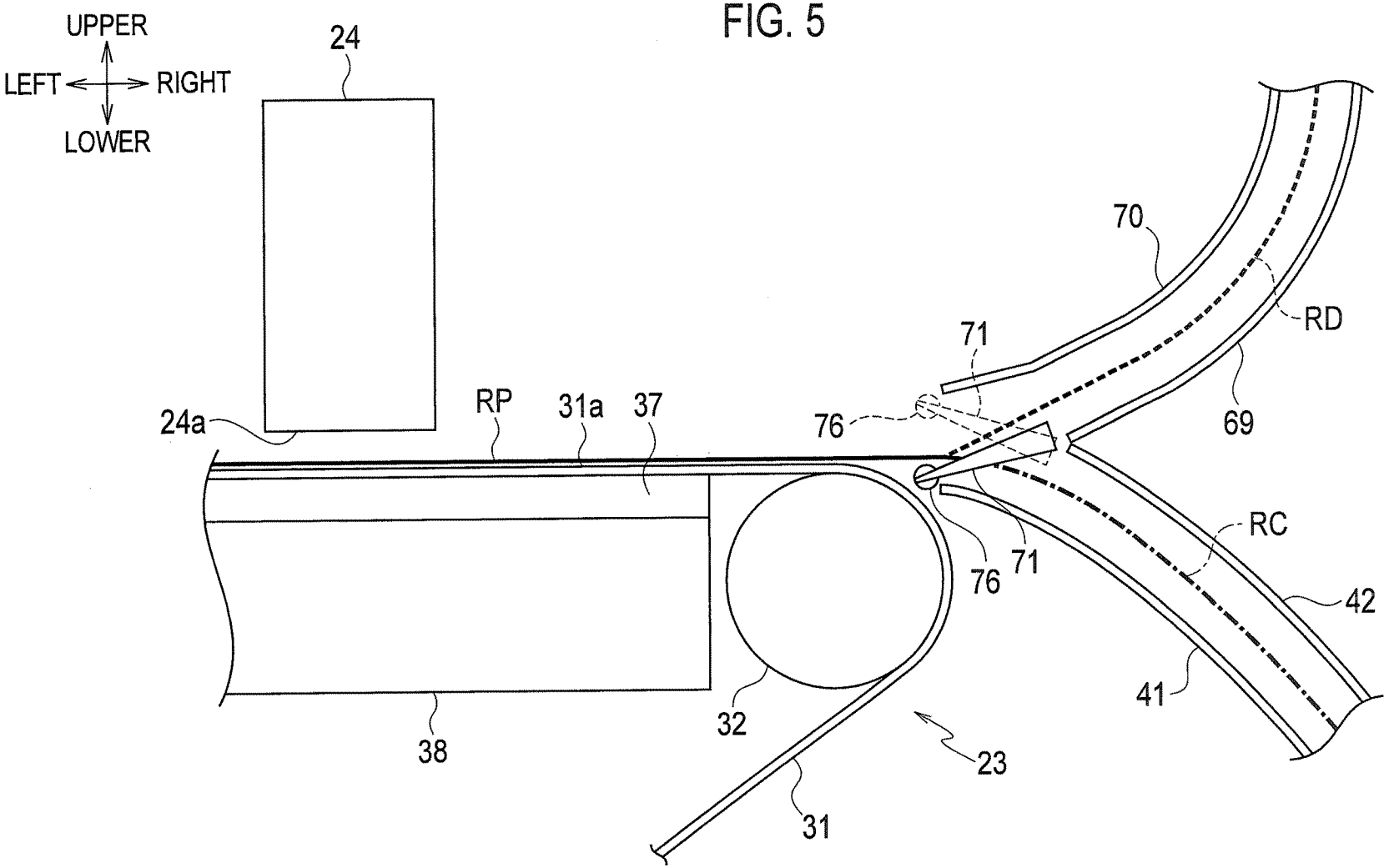
FIG. 5 is an enlarged front view showing a featured portion surrounding the flopper.

The circular transfer portion 4 transfers a paper P whose one side has been printed during duplex printing along the circular path RC to send the paper P to the pair of vertical transfer rollers 18. The circular path RC extends downward from a downstream end of the print path RP, passes beneath the under-head transfer unit 23, and then joins with the internal paper feed path RS2 near an upstream side of the pair of vertical transfer rollers 18. As shown in FIG. 5, a pair of guide plates 41 and 42 for guiding a paper P is provided along the circular path RC.

The circular transfer portion 4 includes the intermediate transfer portion 51, a switch-back portion 52, and a horizontal transfer portion 53.

The intermediate transfer portion 51 receives a paper P whose one side has been printed during duplex printing from the under-head transfer unit 23, and then transfers the paper P to the switch-back portion 52. The intermediate transfer portion 51 is disposed on a downstream side of the under-head transfer unit 23. The intermediate transfer portion 51 includes two pairs of intermediate transfer rollers 56, and an intermediate transfer motor 57.

The pairs of intermediate transfer rollers 56 receive a paper P whose one side has been printed during duplex printing from the under-head transfer unit 23, and then transfer the paper P to a pair of switch-back rollers 58 that will be described later. The two pairs of intermediate transfer rollers 56 are disposed on the circular path RC between the under-head transfer unit 23 and the pair of switch-back rollers 58. A section of on the circular path RC where the pairs of intermediate transfer rollers 56 are disposed is a path extending downward from the transfer surface 31*a* of the under-head transfer unit 23. This section corresponds to a downstream-side transfer path in Claims.

The intermediate transfer motor 57 drives the two pairs of intermediate transfer rollers 56 to rotate them. In addition, the intermediate transfer motor 57 also drives two pairs of paper ejection rollers 66 that will be described later.

The switch-back portion 52 switches back a paper P whose one side has been printed during duplex printing. The switch-back portion 52 includes the pair of switch-back rollers 58, and a switch-back motor 59.

The pair of switch-back rollers 58 switches back a paper P transferred by the pairs of intermediate transfer rollers 56 in order to turn over the paper P. The pair of switch-back rollers 58 is disposed on the circular path RC on a downstream side of the pairs of intermediate transfer rollers 56.

The switch-back motor 59 drives the pair of switch-back rollers 58 to rotate them.

The horizontal transfer portion 53 transfers the paper P from the switch-back portion 52 to the pair of vertical transfer rollers 18 of the paper feeder 2. The horizontal transfer portion 53 includes four pairs of horizontal transfer rollers 60, and two horizontal transfer motors 61.

The pairs of horizontal transfer rollers 60 transfer the paper P switched back by the switch-back portion 52 to the pair of vertical transfer rollers 18 in an area beneath the under-head transfer unit 23. The upstream-side three pairs of horizontal transfer rollers 60 are disposed on a horizontal section of the circular path RC beneath the under-head transfer unit 23. The most-downstream pair of horizontal transfer rollers 60 is disposed on an upslope section of the circular path RC that is located on a downstream side of the horizontal section of the circular path RC.

One of the two pairs of horizontal transfer motors 61 drives the upstream-side two pairs of horizontal transfer rollers 60 to rotate them. Another of the two pairs of horizontal transfer motors 61 drives the downstream-side two pairs of horizontal transfer rollers 60 to rotate them.

The paper ejector 5 ejects a printed paper(s) P. The paper ejector 5 includes three pairs of paper ejection rollers 66, a paper ejection motor 67, and a paper ejection tray 68.

The pairs of paper ejection rollers 66 receive the printed paper P from the under-head transfer unit 23, and then eject it onto the paper ejection tray 68. The pairs of paper ejection rollers 66 are disposed on the paper ejection path RD. The paper ejection path RD is a path extending upward from the transfer surface 31*a* of the under-head transfer unit 23. As shown in FIG. 5, a pair of guide plates 69 and 70 for guiding a paper P is provided along the paper ejection path RD.

The paper ejection motor 67 drives the most-downstream pairs of paper ejection rollers 66 to rotate it. Note that the intermediate transfer motor 57 drives the upstream-side two pairs of paper ejection rollers 66 to rotate them.

On the paper ejection tray 68, the papers P ejected by the pairs of paper ejection rollers 66 are stacked. The paper ejection tray 68 is disposed at a downstream end of the paper ejection path RD.

The change-over unit 6 changes over a transfer destination of the paper P from the print unit 3 between the paper ejector 5 and the circular transfer portion 4. The change-over unit 6 includes the flipper 71, and a solenoid 72.

The flipper 71 leads the paper P transferred from the under-head transfer unit 23 to the paper ejector 5 or the circular transfer portion 4. The flipper 71 is disposed at a position that is a downstream end of the print path RP and also a communal upstream end of the paper ejection path RD and the circular path RC.

Figure 4:
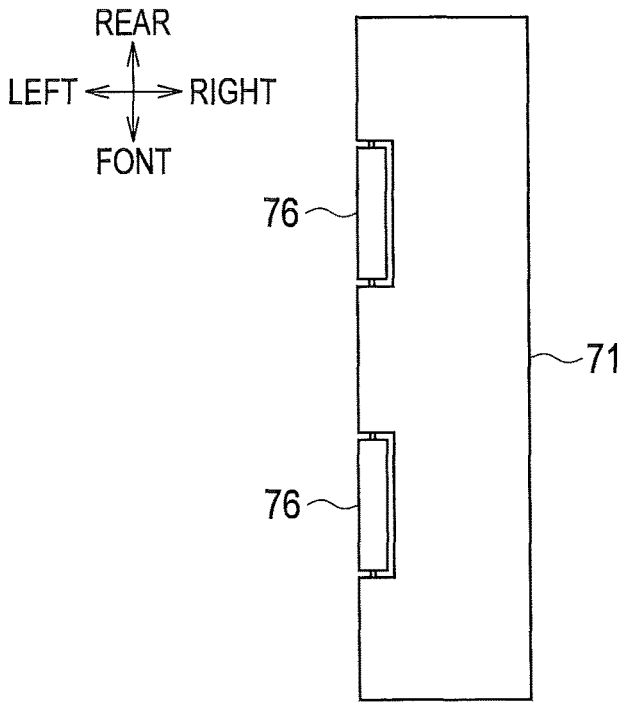
FIG. 4 is a plan view of a flipper of the printer.

As shown in FIG. 4, the flipper 71 is formed to have a long planar shape along the front-rear direction. The flipper 71 is provided with a pair of paper pressure rollers 76 (that corresponds to a rotational member in Claims) along its free-end edge on a side of the under-head transfer unit 23 (along its edge on a left side). When the flipper 71 leads a paper P whose one side has been printed to the circular path RC during duplex printing, the pair of paper pressure rollers 76 presses the paper P while rotating.

Figure 7:
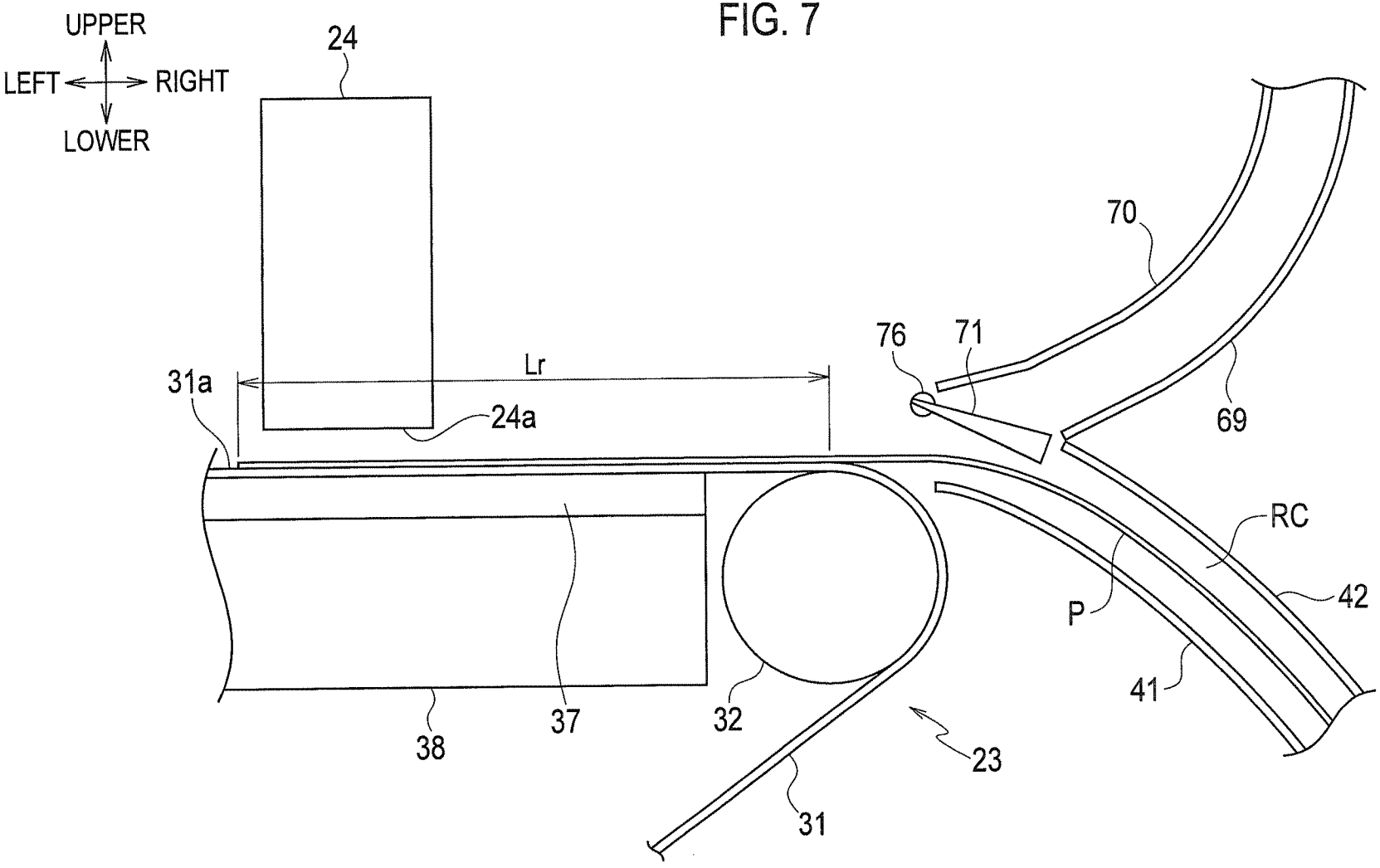
FIG. 7 is an enlarged front view showing the featured portion when a leading end of a paper is led to a circular path.

The solenoid 72 changes over a transfer direction by the flipper 71 between a paper-ejection leading direction and a circular-transfer leading direction. The paper-ejection leading direction is a direction for leading a paper P from the print path RP to the paper ejection path RD (see a dotted line in FIG. 5). The circular-transfer leading direction is a direction for leading a paper P from the print path RP to the circular path RC (see a dashed one-dotted line in FIG. 5). When the solenoid 72 is turned off (not energized), the flipper 71 is oriented to lead a paper P to the paper-ejection leading direction as shown in FIG. 5. When the solenoid 72 is turned on (energized), the flipper 71 is lifted up and thereby the flipper 71 is oriented to lead a paper P to the circular-transfer leading direction as shown in FIG. 7. Note that a paper P to be pressed by the flipper 71 (the pair of paper pressure rollers 76) is not shown in FIG. 5.

The controller 7 controls the components of the printer 1. The printer is configured to be provided with a CPU, a RAM, a ROM, a hard-disk drive, and so on.

The controller 7 executes controls for feeding a paper P to the print unit 3 by the paper feeder 2, and then printing images on the paper P by ejecting inks from the inkjet heads 24 while transferring the paper P by the under-head transfer unit 23. In a case of duplex printing, the controller 7 executes further controls for leading the paper P whose one side has been printed to the circular transfer portion 4 by the flipper 71, transferring the paper P to the pair of vertical transfer rollers 18 after tuning over the paper P by the circular transfer portion 4, and then printing images on another side of the paper P after refeeding the paper P to the print unit 3 by the pair of vertical transfer rollers 18.

When a paper P whose one side has been printed is led to the circular transfer portion 4 from the under-head transfer unit 23 during duplex printing, the controller 7 executes controls for pressing the paper P by the flipper 71 (the pair of paper pressure rollers 76) after a leading end of the paper P is led to the circular path RC by the flipper 71.

Next, operations of the printer 1 will be described.

When printing operations are started, a paper P is drawn out from the external paper feed tray 11 or the internal paper feed trays 13 of the paper feeder 2, and then fed to the print unit 3. The paper P fed to the print unit 3 is transferred to the under-head transfer unit 23 by the pair of registry rollers 21 in the print unit 3. Subsequently, images are printed on the paper P by inks ejected from the inkjet heads 24 while the paper P is transferred by the under-head transfer unit 23.

In a case of single-side printing, the paper P is led to the paper ejection path RD by the flipper 71 while being transferred by the under-head transfer unit 23. The paper P is transferred by the pairs of paper ejection rollers 66, and then ejected onto the paper ejection tray 68.

On the other hand, in a case of duplex printing, the paper P is led to the circular path RC by the flipper 71 while being transferred by the under-head transfer unit 23. The paper P whose one side has been printed and that is led to the circular path RC is transferred to the pair of switch-back rollers 58 by the pairs of the intermediate transfer rollers 56, and then switched back by the switch-back portion 52. The switched-back paper P is transferred to the pair of vertical transfer rollers 18 by the pairs of horizontal transfer rollers 60. Then the paper P is refed to the print unit 3 by the pair of vertical transfer rollers 18. According to this process, the paper P is tuned over.

In the print unit 3, the refed paper P whose one side has been printed is transferred to the under-head transfer unit 23 by the pair of registry rollers 21. Here, since the paper P has been turned over, the paper P is sent to the under-head transfer unit 23 with its unprinted surface faced upward. Subsequently, images are printed on the unprinted surface of the paper P by inks ejected from the inkjet heads 24 while the paper P is transferred by the under-head transfer unit 23.

Then, the paper P is led to the paper ejection path RD by the flipper 71 while being transferred by the under-head transfer unit 23. The paper P whose both sides have been printed is transferred by the pairs of paper ejection rollers 66, and then ejected onto the paper ejection tray 68.

In duplex printing with plural papers P, the paper feeder 2 and the circular transfer portion 4 are controlled so that feeding of an unprinted paper(s) P and refeeding of a paper(s) P whose one side has been printed are done alternately. Then, in the print unit 3, printing on one side of the unprinted paper(s) P and printing on another unprinted side of the paper(s) P whose one side has been printed are done alternately. Therefore, duplex printing is done with equivalent productivity to that in one-side printing.

Next, a flipper change-over process during duplex printing will be described.

The flipper change-over process is a process for changing over the transfer direction by the flipper 71 between the paper-ejection leading direction and the circular-transfer leading direction during duplex printing in order to change over the transfer destination of a paper P between the paper ejector 5 and the circular transfer portion 4.

As described above, a paper P whose one side has been printed during duplex printing is led from the under-head transfer unit 23 to the circular transfer portion 4 by the flipper 71. When a leading end of the paper P led to the circular path RC, an upward force occurs at a trailing end of the paper P due to stiffness of the paper P. In addition, there is an area that cannot be covered by the chamber 38 and in which air is not suctioned through the belt holes at a downstream-side end on the transfer surface 31*a* beneath the under-head transfer unit 23. Therefore, the trailing end of the paper P whose leading end is being led to the circular path RC becomes easily uplifted from the transfer surface 31*a*.

The uplift of the paper P is restricted in the printer 1 by pressing the paper P by use of the flipper 71, when the paper P is being led to the circular path RC. The flipper change-over process includes a process for pressing a paper P by the flipper 71 when leading the paper P to the circular path RC.

Figure 6:
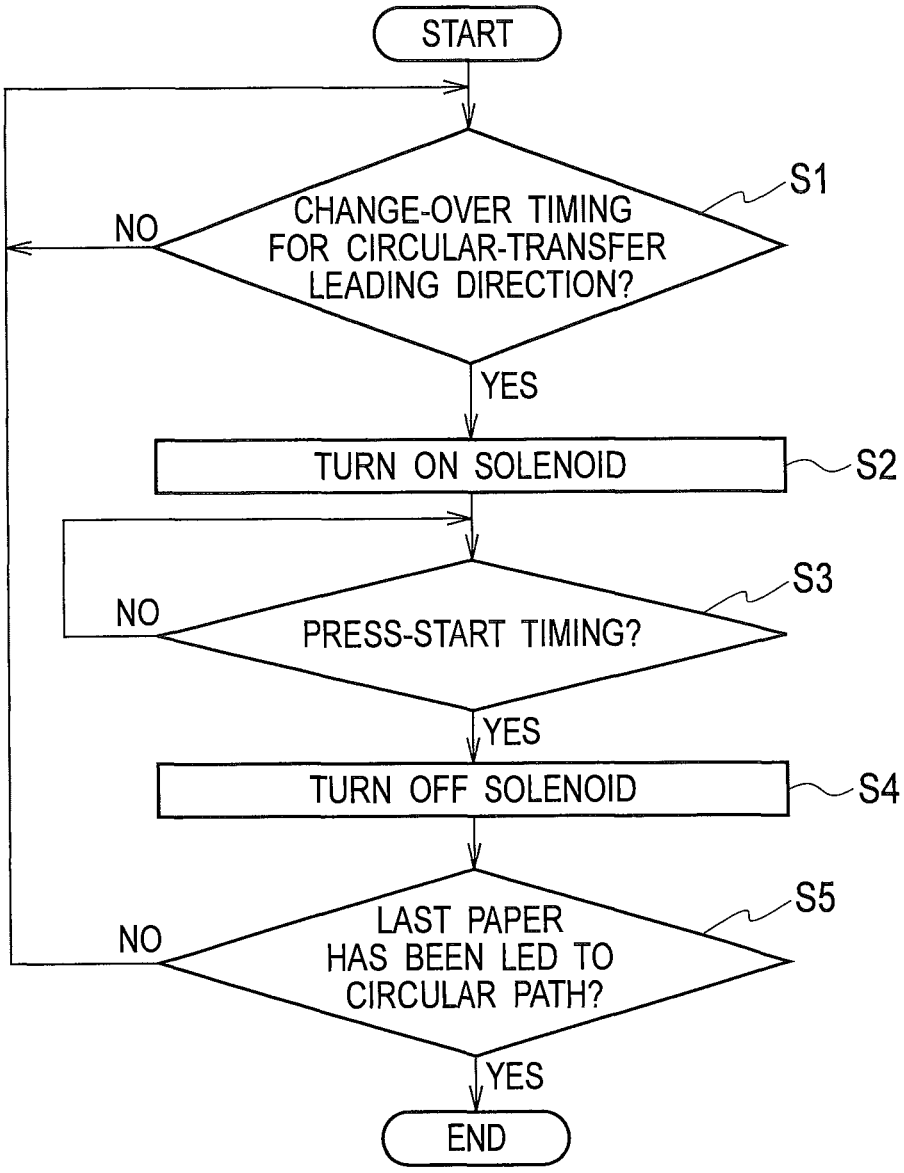
FIG. 6 is a flowchart of a flipper change-over process.

The flipper change-over process is started when a duplicating printing operation is started (see a flowchart shown in FIG. 6).

The controller 7 determines whether or not it is change-over timing to change over the flipper 71 to the circular-transfer leading direction (Step S1). The change-over timing is timing when a leading end of a paper P being led to the circular path RC reaches a predetermined position. When a predetermined time has elapsed from a detection of a leading edge of the paper P being (to be) led to the circular path RC by the paper sensor 25, the controller 7 determines that it is the above-mentioned change-over timing. Here, the solenoid 72 is being tuned off at the start of the duplicate printing operation, so that the transfer direction by the flipper 71 is being set to the paper-ejection leading direction.

When it is determined that it is not the change-over timing (NO in Step S1), the controller 7 repeats the process of the Step S1.

On the other hand, when it is determined that it is the change-over timing (YES in Step S1), the controller 7 turns the solenoid 72 on (Step S2). As the result, the transfer direction by the flipper 71 is changed over from the paper-ejection leading direction to the circular-transfer leading direction. Then, the paper P is led to the circular path RC while being transferred by the under-head transfer unit 23.

Subsequently, the controller 7 determines whether or not it is press-start timing for starting pressing by the flipper 71 (Step S3). The press-start timing is timing when a remained length Lr of the paper P being led to the circular path RC becomes a press-start reference length Lrt.

As shown in FIG. 7, the remained length Lr is a length of a trailing portion of the paper P being led to the circular path RC that is remained on the transfer surface 31*a*.

The press-start reference length Lrt is (can be) determined experimentally as a length that enables of minimizing an contact area between printed images and the pair of paper pressure rollers 76 without making the paper P uplifted from the transfer surface 31*a*. Namely, the press-start reference length Lrt is determined so that pressing of the paper P is started at a position as close as possible to a trailing edge of the paper P under a condition where the paper P is never made uplifted from the transfer surface 31*a*. The press-start reference length Lrt is set as explained above in order to prevent a printed media from being smudged. The press-start reference length Lrt is set according to paper types. The thicker, stronger in stiffness, or more easily lifted up a paper type is, the longer the press-start reference length Lrt is set.

In the Step S3, the controller 7 determines whether or not it is the press-start timing based on an elapsed time from the change-over timing. Here, even for papers P that has the identical press-start reference length Lrt to each other, time from the change-over timing to the press-start timing may differ from each other if paper sizes (paper lengths along a transfer direction) of the papers P differ from each other. Namely, the controller 7 controls the press-start timing according to a paper type and a paper size by controlling the press-start timing based on the press-start reference length Lrt set according to a paper type.

When it is determined that it is not the press-start timing (NO in Step S3), the controller 7 repeats the process of the Step S3.

On the other hand, when it is determined that it is the press-start timing (YES in Step S3), the controller 7 turns the solenoid 72 off (Step S4). When the solenoid 72 is turned off, the free-end edge of the flipper 71 drops down.

Figure 8:
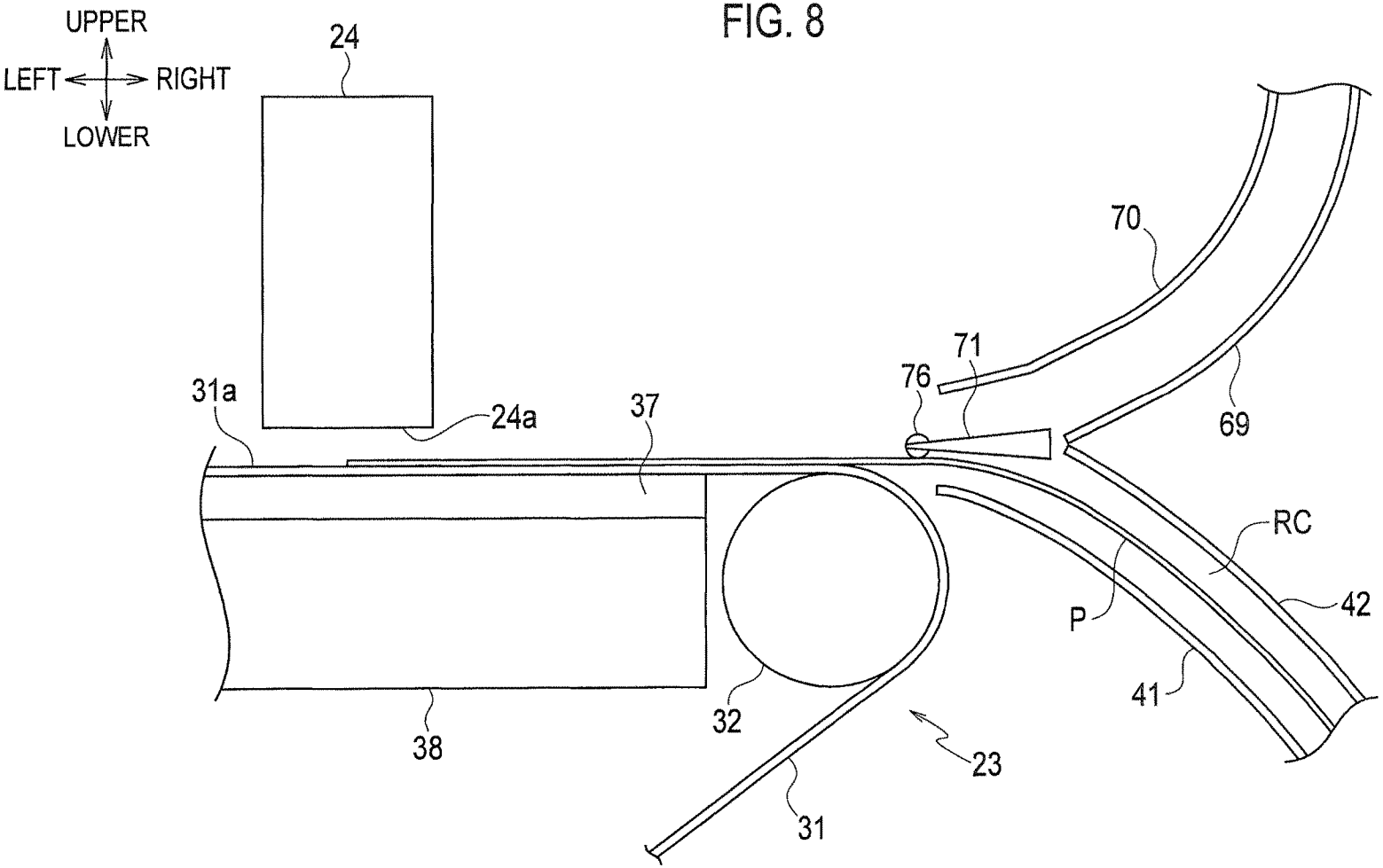
FIG. 8 is an enlarged front view showing the featured portion when the paper is pressed by the flopper.

As the result, the pair of paper pressure rollers 76 of the flipper 71 contacts with the paper P as shown in FIG. 8. Then, the pair of paper pressure rollers 76 presses the transferred paper P while being rotated. Therefore, the paper P can be restricted from being uplifted from the transfer surface 31*a*.

When the trailing end of the paper P passes over the pair of paper pressure rollers 76, leading of the paper P to the circular path RC is accomplished and the free-end edge of the flipper further drops down. As the result, the transfer direction by the flipper 71 is set to the paper-ejection leading direction (see FIG. 6).

After the Step S4, the controller 7 determines whether or not leading of the last paper P (in the number of papers preset to be printed) to the circular path RC is accomplished (Step S5). When it is determined that leading of the last paper P to the circular path RC is not accomplished (NO in Step S5), the controller 7 returns the process flow to the Step S1. On the other hand, when it is determined that leading of the last paper P to the circular path RC is accomplished (YES in Step S5), the controller 7 terminates the flipper change-over process.

As described above, when leading a paper P from the under-head transfer unit 23 to the circular transfer portion 4 during duplex printing in the printer 1, the controller 7 executes the control for pressing the transferred paper P by the flipper 71 after a leading end of the paper P has been led to the circular path RC by the flipper 71. By pressing the paper P as described above, the paper P can be restricted from being uplifted from the transfer surface 31*a*. In addition, since the flipper 71 for changing over the transfer paths is used for pressing the paper P, it is not needed to an additional component such as a roller(s) dedicated only for pressing the paper P. Therefore, according to the printer 1 (the paper transfer device in the present embodiment), the device can be prevented from being complicated, and an uplift of a paper P from the transfer surface 31*a* can be suppressed.

In addition, the controller 7 controls the press-start timing according to a paper type and a paper size. Therefore, a paper P can be restricted from being uplifted from the transfer surface 31*a* while a printed media can be restricted from being smudged by minimizing the contact area between printed images and the pair of paper pressure rollers 76.

Further, the pair of paper pressure rollers 76 presses the paper P while rotating, and thereby smudges of a printed media caused by being pressed can be restricted.

Note that the press-start timing is controlled according to a paper type and a paper size in the above embodiment. However, the press-start timing may be controlled according to on any one of a paper type and a paper size. According to this configuration, a paper P can be restricted from being uplifted from the transfer surface 31*a* while a printed media can be restricted from being smudged The press-start timing may be controlled regardless of a paper type and/or a paper size. For example, timing after a fixed time has elapsed from the change-over timing may be set as the press-start timing.

The flipper 71 provided with the pair of paper pressure rollers 76 is used in the above embodiment. However, a flipper that has no paper pressure roller may be used. According to this configuration, the device can be prevented from being complicated, and an uplift of a paper P from the transfer surface 31*a* can be suppressed.

Only a paper P whose one side has been printed during duplex printing is pressed by the flipper 71 (the pair of paper pressure rollers 76) in the above embodiment. The paper P whose one side has been printed during duplex printing is led to the circular path RC extending downward from a downstream end of the print path RP, and may have minute wavings caused by ink infiltration. As the result, a trailing end of the paper P whose one side has been printed during duplex printing tends to be uplifted more easily than an unprinted paper, and is prevented from being uplifted by the flipper 71 (the pair of paper pressure rollers 76) in the above embodiment. Therefore, it is effective to press a paper P whose one side has been printed by the flipper 71 (the pair of paper pressure rollers 76) when leading the paper to a transfer path extending downward (to the circular path RC in the above embodiment).

Note that, in the above embodiment, a paper P whose one side has been printed during one-side printing and a paper P whose both sides have been printed during duplex printing are led to the paper ejection path RD extending upward from a downstream end of the print path RP. Therefore, a trailing end of such a paper P is not uplifted, so that it is not necessarily needed to be pressed by the flipper 71 (the pair of paper pressure rollers 76).

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims benefit of priority under 35 U.S.C. §119 to Japanese Patent Application No. 2015-38102, filed on Feb. 27, 2015, which is incorporated herein by reference.

What is claimed is:

1. A paper transfer device comprising:

a paper transfer unit that transfers a paper laid on a transfer surface beneath an inkjet head;

a downstream-side transfer portion that is disposed on a downstream side of the transfer unit along a transfer direction of the paper, and transfers the paper along a downstream-side transfer path extending downward from the transfer surface;

a flipper that leads the paper from the transfer unit to the downstream-side transfer portion;

an actuator connected to the flipper that moves the flipper;

a controller that controls the actuator to press the paper by the flipper after a leading end of the paper is led to the downstream-side transfer portion by the flipper; and a paper sensor that detects the leading end of the paper.

2. The paper transfer device according to claim 1, wherein the flipper includes a rotational member that presses the paper while the rotational member rotates.

* * * * *